US006041634A

United States Patent [19]

McNally

[11] Patent Number: 6,041,634

[45] Date of Patent: *Mar. 28, 2000

[54] PORTABLE BEAD ROLLER

[75] Inventor: Patrick David McNally, Canton, Mich.

[73] Assignee: Detroit Diesel Corporation, Detroit, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/955,408

[22] Filed: Oct. 21, 1997

[51] Int. Cl.[7] ..... B21D 17/04

[52] U.S. Cl. ..... 72/105; 72/101

[58] Field of Search ..... 72/101, 105, 106

[56] References Cited

U.S. PATENT DOCUMENTS

| | | | |
|---|---|---|---|
| 2,748,828 | 6/1956 | West | 72/101 |
| 3,015,502 | 1/1962 | Frost et al. | 72/101 |
| 3,541,826 | 11/1970 | Halliburton | 72/105 |

*Primary Examiner*—Lowell A. Larson
*Attorney, Agent, or Firm*—Bill C. Panagos

[57] ABSTRACT

A machine for forming a bead on a tubular work piece includes a first circular die engageable with the inner surface of the tubular work piece and a second circular die engageable with the outer surface of the tubular work piece. The first die cooperatively engages the second die so that the work piece material is reformed into a bead by a bending process and also by an extrusion process. Tubular stock having a relatively large wall thickness can be handled by the machine.

6 Claims, 1 Drawing Sheet

Fig-1
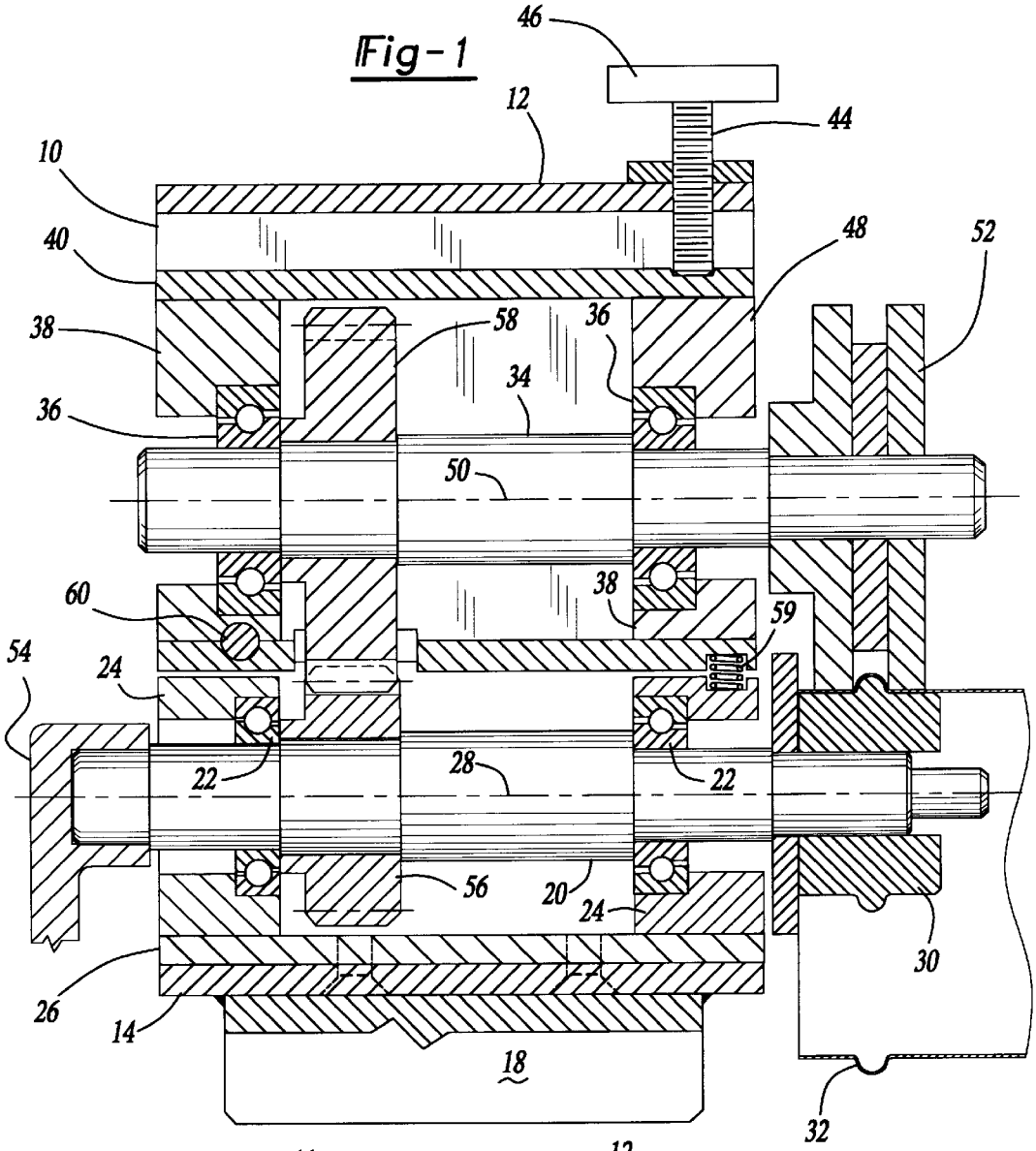
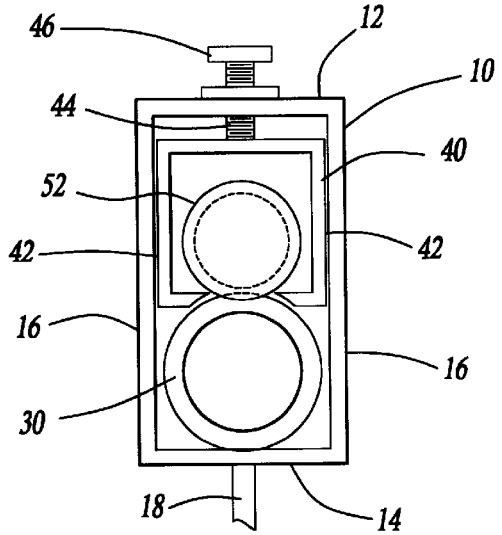
Fig-2

PORTABLE BEAD ROLLER

BACKGROUND AND SUMMARY OF THE INVENTION

This invention relates to a bead-forming machine, and particularly to a bead-forming machine capable of forming annular beads in relatively thick-walled steel tubing, e.g. twelve gauge or sixteen gage steel tubing.

Commercial bead-forming machines are marketed by various companies, additional companies are using bead-forming machines of various types to produce enhanced value tubing products. In most cases the bead-forming machinery is used with thin-walled tubing that is relatively deformable, e.g. copper or aluminum.

The present invention is concerned with a bead-forming machine capable of forming a bead (or flare) in a relatively thick-walled tubing, e.g. steel tubing having a relatively thick wall. The invention is usable with twelve gauge or sixteen gauge steel tubing.

In one preferred embodiment of the invention, the machine comprises an internal circular die (roller) adapted to engage the inner surface of a tubular work piece, and an external circular die (roller) adapted to engage the outer surface of the tubular work piece. The work piece material between the two dies is subjected to a squeezing (extrusion) force as the material passes through the restricted space provided by the mandrels.

The extrusion action of the dies produces an ironing action on the work piece material, such that irregularities and wrinkles are effectively removed from the bead formed by the mandrels. During the bead-forming operation the work piece material is subjected to bending forces and also extrusion forces. The combination of forces produces a uniform cross section bead in a relatively thick-walled steel tubing work piece.

Further features of the invention will be apparent from the attached drawing and description of a preferred embodiment of the invention.

THE DRAWINGS

FIG. 1 is a sectional view taken through a bead-forming machine constructed according to the invention.

FIG. 2 is an end view of the FIG. 1 machine taken on a reduced scale.

DESCRIPTION OF A PREFERRED EMBODIMENT OF THE INVENTION

The drawing shows a bead-forming machine for a tubular work piece embodying features of the invention. The machine comprises a casing 10 that includes a top wall 12, bottom wall 14, and two parallel side walls 16. The casing has a rectangular hollow tubular configuration, as viewed in FIG. 2.

A vertical fin wall 18 extends downwardly from bottom wall 14 to form a portable means for mounting the casing 10 on a vise, not shown. With fin wall 18 clamped between the jaws of a stationary vise, casing 10 will assume a horizontal stationary position above the vise jaws.

The working mechanism of the bead-forming machine comprises a lower horizontal shaft 20 suitably supported in anti-friction bearings 22. Each bearing is mounted in a block 24 that is suitably affixed to a mounting plate 26 carried on the bottom wall of casing 10. Shaft 20 is capable of rotation around shaft axis 28. The shaft carries a circular die 30 that is adapted to engage the inner surface of a tubular work piece. For illustration purposes a representative work piece is shown in dashed lines and designated by numeral 32.

The working mechanism of the machine further comprises an upper horizontal shaft 34 supported in two axially-spaced anti-friction bearings 36. Each bearing block 38 suitably affixed to a hollow carrier 40. Carrier 40 comprises two parallel side walls 43 slidably engaged with the side walls 16 of casing 10, whereby the carrier can be adjusted vertically toward or away from the lower horizontal shaft 20, pivoting an pin 60 and having constant upward pressure from biasing means 61, depicted as a spring.

The adjusted position of carrier 40 can be controlled by a manually-operated screw 44. By turning the thumb wheel 46 it is possible to rotate the screw so as to move carrier 40 up or down in casing 10. Screw 40 has meshed engagement with a threaded hold formed in the top wall 12 of the casing. The lower end of screw 44 engages wall 40.

Shaft 34 is capable of rotation around shaft axis 50. The shaft carries an external circular die 52 that is radially aligned with the mating die 30 on shaft 20. The bead-forming operation is carried out by advancing carrier 40 downwardly so that the edges of the dies are in pressure contact with the inner and outer surfaces of the tubular work piece, as shown e.g. in FIG. 1. The two shafts 20 and 34 are then rotated in unison that that the tubular work piece is frictionally driven in a rotational orbit around the internal mandrel 30. During this operation the bead is formed in the wall of the tubular work piece.

The left end of shaft 20 is connected to a hand crank 54, whereby shaft 20 is rotated by manual rotational movement of the crank. Shaft 20 rotation is transmitted to upper shaft 34 by a gear system that includes a gear 56 carried by shaft 20 and a gear 58 carried by shaft 34.

As the work piece material passes through the restricted space formed by the confronting edges of the two dies 30 and 52 the work piece material is subjected to an extrusion force, due to the fact that the edge surface of die 30 is moving along the edge surface of die 52. The die surfaces cooperatively reform the workpiece material while at the same time bending the material to the cross sectional shape of the restricted space. Any wrinkles or surface irregularities that might otherwise be produced are ironed out (removed). The extrusion action tends to thin out the material, so that relatively heavy gauge tubular stock can be processed through the machine.

The drawings show hand crank 54 applied to shaft 20. However, by suitable redesign the hand crank could be attached to the other shaft 34. Alternately, a servo motor could be provided for turning shaft 20. Other variants and alternative constructions could be employed while still practicing the invention.

Substitution of dies having differing edge configurations enables the machine to form different types of beads, e.g. radial flanges, multiple crimps, reverse end turns, etc.

While the foregoing describes one preferred embodiment of the invention, it is not to be construed as limiting the invention as many variations and modifications will become apparent to one skilled in the art, without deporting from the scope and spirit of the invention as set forth in the appended claims.

What is claimed:

1. A machine for forming a bead on a tubular workpiece, comprising:

(a) a hollow carrier comprised of a hollow tubular rectangular housing;

(b) a first lower horizontal shaft, and first means supporting said shaft for rotary motion around the shaft axis; said first horizontal shaft and supporting means carried within said hollow carrier;

(c) a first internal circular die mounted on said lower shaft for contacting the inner surface of a tubular workpiece;

(d) a second upper horizontal shaft and second means for supporting said second shaft for motion around the second shaft; said second shaft and supporting means located within a rectangular hollow housing, said housing pivotally carried within said hollow carrier and having sidewalls slidably engaged within said hollow carrier;

(e) a second external circular die mounted on said upper shaft in radial alignment with said first die, whereby the wall of a tubular workpiece can be subjected to a squeeze force by moving the rectangular hollow housing downwardly toward the second shaft;

(f) a first gear carried by said first shaft, and a second gear carried by said second shaft; said gears being in mesh with each other for transmitting rotational motion from one shaft to the other, and means for rotating one of said shafts.

2. The machine of claim 1, wherein said shaft rotating means comprises a hand crank connected to said lower shaft.

3. The machine of claim 1, and further comprising manual means for adjusting said hollow housing toward or away from said lower shaft.

4. The machine of claim 3, wherein said manual adjusting means comprises a manually operated screw.

5. The machine of claim 3, wherein said second shaft support means comprises two axially-spaced anti-friction shaft bearings located in said rectangular hollow housing.

6. The machine of claim 5, wherein said second gear is located between said axially-spaced shaft bearings.

* * * * *